US010542797B2

(12) United States Patent
Roux-Fouillet

(10) Patent No.: US 10,542,797 B2
(45) Date of Patent: Jan. 28, 2020

(54) ITEMS OF JEWELRY AND A METHOD OF PRODUCING SUCH ITEMS

(71) Applicant: David Marie Severin Roux-Fouillet, London (GB)

(72) Inventor: David Marie Severin Roux-Fouillet, London (GB)

( * ) Notice: Subject to any disclaimer, the term of this patent is extended or adjusted under 35 U.S.C. 154(b) by 467 days.

(21) Appl. No.: 14/894,983

(22) PCT Filed: Jun. 2, 2014

(86) PCT No.: PCT/GB2014/000207

§ 371 (c)(1),
(2) Date: Nov. 30, 2015

(87) PCT Pub. No.: WO2014/191711

PCT Pub. Date: Dec. 4, 2014

(65) Prior Publication Data

US 2016/0113362 A1 Apr. 28, 2016

(30) Foreign Application Priority Data

May 31, 2013 (GB) ..... 1309764.7

(51) Int. Cl.
*A44C 27/00* (2006.01)
*A44C 13/00* (2006.01)
(Continued)

(52) U.S. Cl.
CPC ..... *A44C 27/00* (2013.01); *A44C 13/00* (2013.01); *A44C 17/04* (2013.01); *A44C 5/0084* (2013.01); *A44C 9/00* (2013.01)

(58) Field of Classification Search
CPC ..... A44C 5/00; A44C 5/0084; A44C 5/0092; A44C 9/00; A44C 17/02; A44C 17/04;
(Continued)

(56) References Cited

U.S. PATENT DOCUMENTS 5,116,009 A * 5/1992 Bayer ..... F21V 5/06 248/303
5,682,736 A * 11/1997 Chia ..... A44C 11/00 59/35.1

(Continued)

FOREIGN PATENT DOCUMENTS

| | | | |
|---|---|---|---|
| BE | 894274 | A2 | 1/1983 |
| EP | 0671135 | A1 | 9/1995 |
| FR | 2384468 | A1 | 10/1978 |

*Primary Examiner* — Sarang Afzali
*Assistant Examiner* — Darrell C Ford
(74) *Attorney, Agent, or Firm* — AEON Law, PLLC; Adam L. K. Philipp; David V. H. Cohen

(57) ABSTRACT

A method of producing a jewelry item. The method comprises producing an annular or partially annular substrate formed with a plurality of slots extending from its inner periphery towards its outer periphery. A plurality of insert members are produced each formed with a slot and at least two bordered openings one to each side of the slot. The insert members are located in turn into the slots of the annular or partially annular substrate with the slots of the substrate and the insert members inter-engaging whereby each insert member is positioned generally normal to the annular or partially annular substrate. Gemstones are then located between each pair of neighboring insert members above with edges of each gem stone or the like located in the openings formed in the insert members.

17 Claims, 5 Drawing Sheets

(51) Int. Cl.
*A44C 17/04* (2006.01)
*A44C 5/00* (2006.01)
*A44C 9/00* (2006.01)

(58) Field of Classification Search
CPC ..... A44C 27/00; A44C 13/00; Y10T 29/23; Y10T 29/49588; Y10T 29/4959; Y10T 29/49591; Y10T 29/49593; Y10T 29/49595; Y10T 29/49597
USPC ..... 63/3, 15, 26, 27; 29/10, 896.4, 896.412
See application file for complete search history.

(56) References Cited

U.S. PATENT DOCUMENTS 5,765,398 A * 6/1998 Bardisbanyan ..... A44C 17/046 29/10
6,490,886 B1 * 12/2002 Steinhauer ..... A44C 9/00 63/15
6,829,882 B2 * 12/2004 Chia ..... A44C 11/00 59/3
7,086,218 B1 8/2006 Pasach
7,143,607 B2 * 12/2006 Hartgrove ..... A44C 17/0208 63/29.1
2002/0083738 A1 * 7/2002 Katz ..... A44C 11/007 63/31
2003/0101747 A1 * 6/2003 Feldman ..... A44C 11/007 63/26
2005/0120746 A1 * 6/2005 Winston ..... A44C 5/08 63/38
2005/0172766 A1 * 8/2005 Bayer ..... F21V 5/06 83/13
2006/0254313 A1 11/2006 Koren
2007/0056321 A1 * 3/2007 Sowle ..... A44C 9/00 63/40
2009/0056373 A1 * 3/2009 Czajka ..... A44C 5/0084 63/3
2011/0011131 A1 1/2011 Bisserier
2015/0013161 A1 * 1/2015 Gracia ..... A44C 5/04 29/896.411
2018/0000205 A1 * 1/2018 Chinowsky ..... A44C 5/0015
2018/0332932 A1 * 11/2018 Ogata ..... A44C 17/02

* cited by examiner

ITEMS OF JEWELRY AND A METHOD OF PRODUCING SUCH ITEMS

FIELD OF THE INVENTION

This invention relates to a method of producing jewelery items from a selection of jewelery pieces such as gemstone. The invention also relates to jewelery items produced by this method.

The term "jewelery pieces" as used herein is intended to include, but is not limited to, gem stones.

The term "jewelery items" includes, but is not limited to, rings, earrings, bracelets and pendants.

BACKGROUND TO THE INVENTION

Many known methods of producing rings and other items of jewelery are time consuming and rely on relatively large quantities of cast metal to retain gem stones and other jewelery pieces in place during and after the manufacturing process.

The present invent sets out to provide an alternative manufacturing process which does not suffer from this and other disadvantages of known processes.

SUMMARY OF THE INVENTION

In one aspect the invention provides a method of producing a jewelery item which comprises taking an annular or partially annular substrate formed with a plurality of slots extending from its inner periphery towards its outer periphery, taking a plurality of insert members each formed with at least one slot and at least one bordered or partially bordered opening alongside one or each slot, locating the insert members in turn into slots of the annular substrate with the slots of the substrate and the insert members inter-engaging whereby each insert member is positioned generally normal to the annular substrate, and locating one or more jewelery pieces in turn between each pair of neighbouring insert members with edge surfaces of each jewelery piece located in the openings formed in neighbouring insert members.

Two such annular or partially annular substrates may be employed, one positioned above the other with slots of the insert members inter-engaging with slots of the insert members.

The outer edge of each substrate may be plain or may include a series of indents for receiving surfaces of jewelery pieces.

Preferably, each slot of each the substrate extends to a position which equates to approximately one half of the width of the substrate.

In a preferred embodiment, one side edge of each slot of the or each substrate lies along a radius of the substrate with the opposed side edge of each slot including an initial length which is inclined away from the said one side edge and a second length which projects to the end face of the slot and is inclined towards the said one side edge.

The slots of the/or each substrate are preferably generally radially aligned.

When engaged, the insert members are preferably positioned normal to the/or each substrate.

In one arrangement, each insert member comprises a single slot positioned between two bordered openings.

In another embodiment, each insert member comprises a single bordered opening positioned between two slots.

The slots of the/or each substrate may be evenly spaced about the internal periphery of the substrate.

In a further arrangement, each insert member comprises two slots positioned between two end pieces and a centre piece, each end piece including a bordered opening and the centre piece including one or more bordered openings.

The jewelery pieces may subsequently be secured in place.

In one arrangement the jewelery pieces are secured in place by tack welding the insert members to the/or each annular substrate. Preferably the welding is effected by a laser welding technique. Other tack welding techniques could, however, be employed.

The/or each annular substrate and/or the insert members may be precision cut from a sheet of a suitable material. Typically, this material comprises a hard metal such as platinum or a metal in its hardened state. Alternatively, the substrate and/or the insert members may be produced from a suitable synthetic ceramic material. Other materials having the appropriate properties could also be employed.

The width of each slot formed in the annular substrate is preferably equal to (or substantially equal to) the thickness of the insert members. Similarly, the width of the slots formed in each insert member is preferably equal to (or substantially equal to) the thickness of the substrate.

In another aspect the invention provides a method of producing a jewelery item from one or more annular or partially annular substrates, a plurality of insert members and a plurality of jewelery pieces, the or each substrate including a plurality of generally radial slots which extend from its inner periphery towards its outer periphery, and each insert member including at least one slot and at least one bordered or partially bordered opening alongside the or at least one slot, the method comprising the steps of engaging in turn the or one slot of each insert member within a slot of the or each substrate, locating between the bordered or partially bordered openings of neighbouring insert members a jewelery piece with opposed side edges of the jewelery piece located within the bordered or partially bordered openings of the neighbouring inserts, and repeating these steps until jewelery pieces are located between each neighbouring pair of inserts.

In a further aspect, the invention provides an item of jewelery produced by the method set out in the previous sixteen paragraphs.

BRIEF DESCRIPTION OF THE DRAWINGS

The invention will now be described by way of example only with reference to the accompanying diagrammatic drawings, in which.

DETAILED DESCRIPTION OF THE INVENTION

Figure 3:
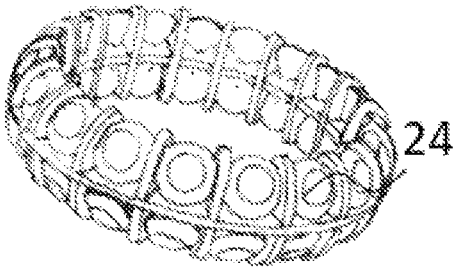
FIG. 3 illustrates an item of jewelery manufactured in accordance with the exemplified method of the invention.

The method described below is for producing a ring inset with gem-stones. Such a ring is illustrated in FIG. 3 of the drawings. It is to be understood however, that the method has application to the manufacture of a wide range of jewelery items of which a ring is just one example. It is also to be understood that a gem-stone is only one of several jewelery pieces which can be used in the production of jewelery items by the method to be described below.

Figure 1:
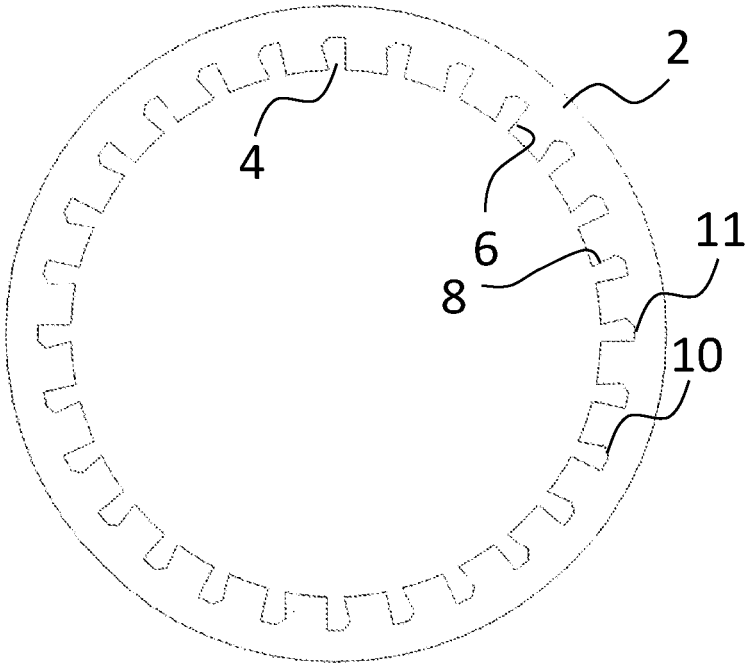
FIG. 1 shows in plan view a first ring-shaped substrate used in the exemplified method of this invention and which forms part of an item of jewelery manufactured in accordance with the invention.

FIG. 1 illustrates a ring-shaped substrate 2 which acts as a pattern during the manufacture of the ring. The ring-shaped substrate is precision cut from a sheet of a metal or other material. Typically the metal is a hard metal such as platinum or a metal in its hardened state. Other materials including synthetic ceramic materials could however be employed. The thickness of the sheet is typically between 0.5 mm and 2 mm. The circumference of the substrate 2 is shown in the drawings as being plain. This may not always be the case. The circumference could, for example, be patterned.

As will be seen from FIG. 1, a plurality of discrete generally radial slots 4 are precision cut into the internal periphery of the substrate 2, each slot 4 extending to a position which approximates to one half of the width of the substrate. One side edge 6 of each slot 4 lies along a radius of the substrate 2 whereas the other side edge of each slot is shaped to include an initial length 8 which is inclined away from the side edge 6 and a second length 10 which projects to the end face 11 of the respective slot 4 and which is typically inclined towards the side edge 6.

As shown, the slots 4 are evenly spaced about the internal periphery of the ring-shaped substrate 2. This need not be the case. Thus, the spacing between each neighbouring pair of slots may be selected to produce a jewelery item in which some gem stones are of different size to other gem stones.

The ring-shaped substrate 2 is preferably produced by a laser cutting technique.

Figure 2:
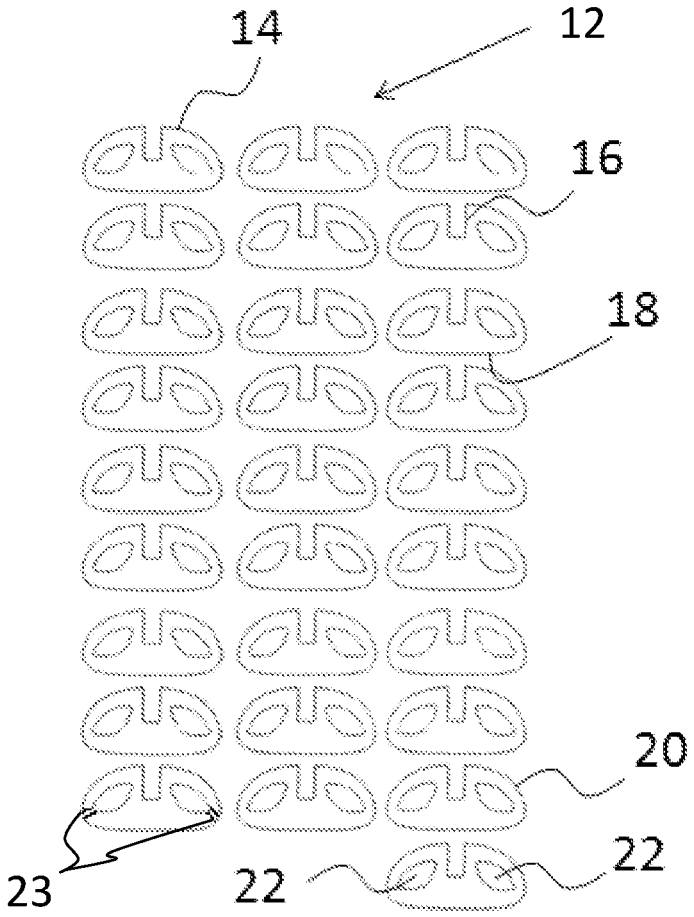
FIG. 2 is a plan view showing a plurality of insert members which co-operate with the ring-shaped substrate illustrated in FIG. 1 in the exemplified method of this invention and which also forms part of a jewelery item manufactured in accordance with the invention.

Insert members 12 are illustrated in FIG. 2. Each insert member has a curvilinear edge 14 which includes a parallel sided slot 16 of width equal to (or marginally greater than) the thickness of the ring-shaped substrate 2. The length of each slot 16 is equal to the distance between the slots 4 and the outer periphery of the ring-shaped substrate 2. The side edge 18 of each insert member remote from the edge 14 is generally flat with the edges of the member ends 20 smoothly merging between the edges 14 and 18. Each insert member 12 is formed with two shaped holes 22 formed one to each side of the slot 16, the purpose of which will be described below.

One insert member 12A differs from the other members in that it includes two cuts 23 which extend from the insert periphery to the boundaries of the holes 22. As will be explained below, the cuts 23 are provided to assist fitting of the final stones of the jewelery item.

The insert members also act as patterns during the manufacture of the jewelery item and are also precision cut from a sheet of metal or other material having the same or similar properties as those of substrate 2. Typically, the substrate and the insert members are precision cut from the same sheet. They may, however, be cut from another material sheet depending on the design and visual effect to be produced.

Thus, the substrate could be produced from a ceramic material and the inserts from a metallic material. In this case, the width of each slot 4 is the same or substantially the same as the sheet thickness. Typically the slots 4 are around 0.01 mm wider than the thickness of the sheet.

The number of insert members 12 is the same as the number of radial slots 4.

The exposed edges of the substrate 2 and the insert members 12 in the finished ring will be seen in FIG. 3.

As will be explained below, jewelery pieces such as gem stones 24 are positioned in turn between neighbouring insert members above and below the ring-shaped substrate with opposite side edges of each stone positioned firmly within the openings 22 of the neighbouring pair of insert members. The gem stones are typically brilliant or oval cut to define side edges capable of locating firmly within the holes 22. Any conventional jewelery gem stone can be used, these including diamonds, sapphires and rubies.

Figure 4:
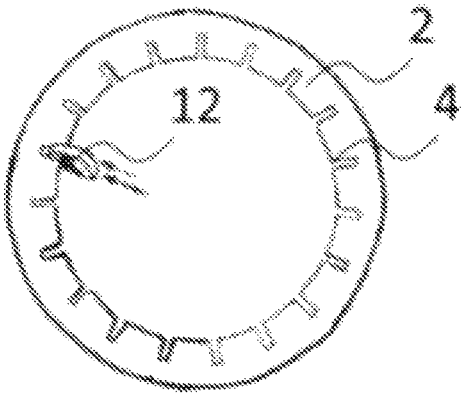

Turning now to FIG. 4 of the drawings, the first step in the manufacturing process is to position one insert pattern 12 so that its slot 16 extends into one of the radial slots 4 of the ring-shaped substrate 2, and then to move the insert member through the slot until its edge 14 is aligned with the outer periphery of the substrate 2.

Figure 5:
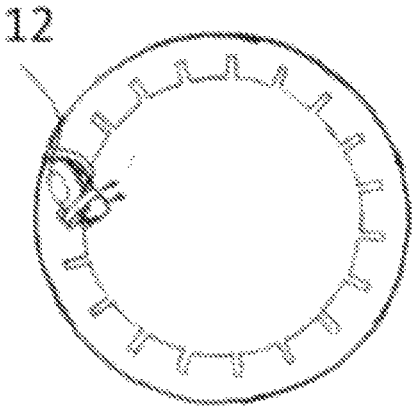
FIGS. 5, and 6 illustrate sequential steps taken to produce the jewelry item illustrated in FIG. 3.

As will be seen from FIG. 5, a second insert member 12 is then similarly positioned in an adjoining slot 4 of the substrate 2. Gem stones 24 are then positioned using tweezers or the like between the opposed side surfaces of the neighbouring insert members 12 with their precisely shaped edges located within the holes 22 of the two insert members 12 above and below the ring-shaped substrate 2. Each freshly introduced module of inserts and gem stones secures the adjoining such module firmly in place.

The shaping of the sides 8 of the slots 4 enable the insert members 12 to move to a limited extent within the slots to facilitate correct positioning of the gem stones between neighbouring insert members 12.

Figure 6:
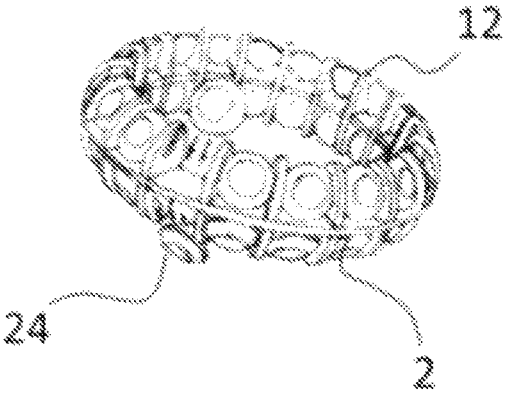

This process continues until the position shown in FIG. 6 where only two final gem stone receiving spaces remain. These spaces are defined on one side by an insert member 12 and on their other side by insert member 12A. Because the space available for movement of the final gem stones between the adjacent insert members is either very limited or non-existent, the part of member 12A above the cut 23 is lifted relative to that part below the cut to enable a stone or stones to be slid into place. The parts of member 12A above and below the cut 23 are then pressed together so that they adopt their original positions and the cut is closed by laser welding to secure the stone or stones securely in place.

Each insert member is then laser tacked onto the ring shaped member before final polishing of the jewelery item.

The number of slots formed in the/or each substrate can, of course, vary depending on the design of the jewelery item to be produced. Thus, the spacing between the slots 4 of the/or each substrate may differ to accommodate differently sized jewelery pieces. Furthermore, the annular or partially annular shaping of the/or each substrate may vary depending upon the jewelery item to be produced. For example, an earring, broach or pendant could readily be produced using an oval or similarly shaped substrate.

Figure 7A:
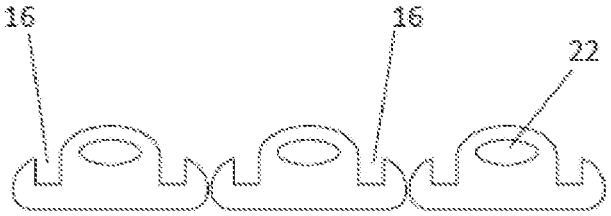
FIGS. 7A, 7B, and 7C illustrate alternative substrates and insert members in accordance with this invention.
Figure 7B:
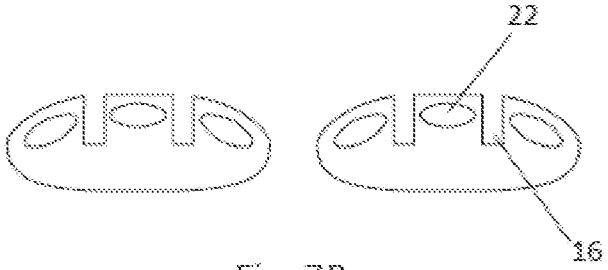
Figure 7C:
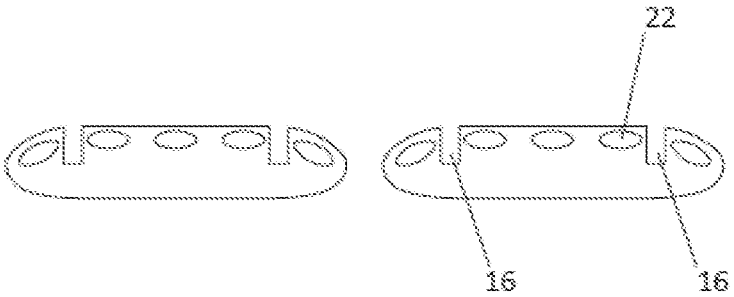
Figure 11:
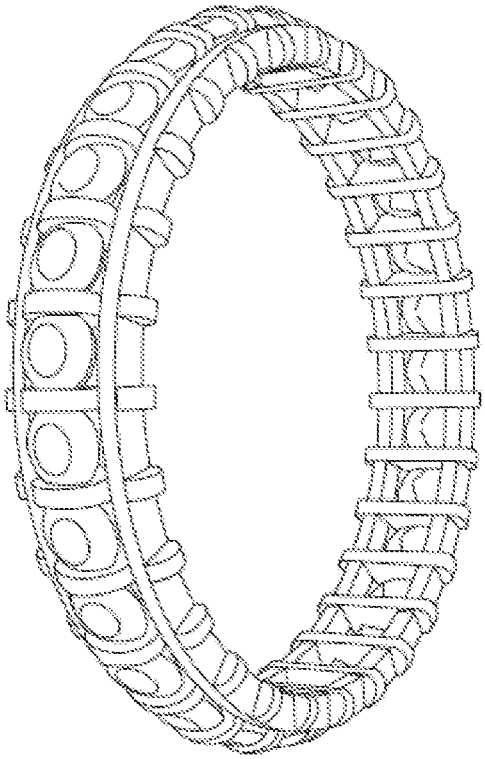

Three different insert members in accordance with the invention are illustrated in FIGS. 7A, 7B and 7C. Each of the insert members illustrated in FIG. 7A has only one bordered opening 22 positioned between two slots 16. A jewelery item produced from a series of such insert members and a pair of substrates 2 is illustrated in FIG. 11. As will be seen, the produced item comprises a single array of gem stones or other jewelery pieces.

Each insert member illustrated in FIG. 7B comprises two slots 16 positioned between three bordered openings 22. These insert members would be used in combination with two substrates for the production of jewelery items which comprise three arrays of jewelery pieces.

The inserts illustrated in FIG. 7C each comprise a pair of slots 16 bordered on one side by one opening 22 located in each end section of the insert, three openings 22 being positioned in the central section of the insert. These inserts will be employed for the production of jewelery items having five arrays of jewelery pieces.

Figure 8:
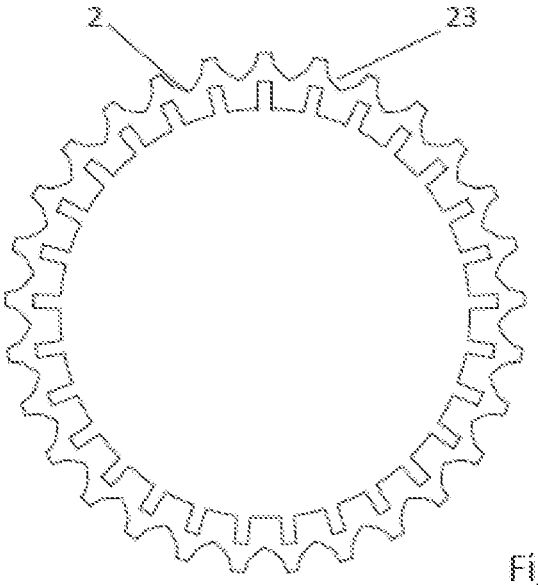
FIG. 8 illustrates an alternative substrate in accordance with the invention.

The substrate 2 illustrated in FIG. 8 differs from that of FIG. 1 in that it's outer circumference is formed with a series of generally semi-circular indents 23.

Figure 9:
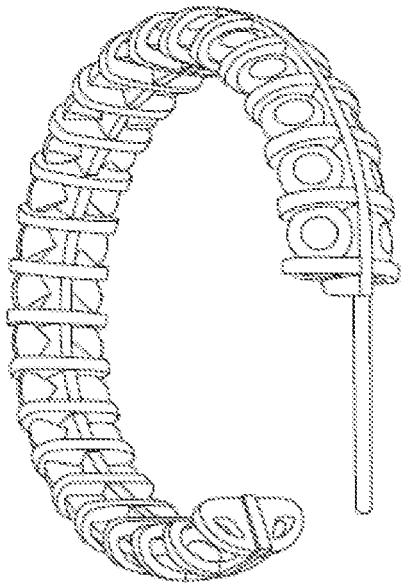
FIGS. 9 to 11 illustrate jewelery items produced in accordance with the invention.
Figure 10:
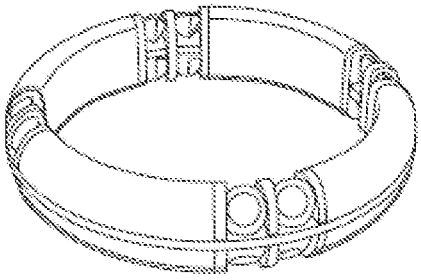

Additional examples of jewelery items to be produced in accordance with this invention are illustrated in FIGS. 9 and 10. FIG. 9 illustrates an earring produced from a partially annular substrate and insert members as illustrate in FIG. 2, and FIG. 10 illustrates a jewelery item in which elongate jewelery pieces 24 are used in combination with gem stones.

It will be appreciated that the foregoing is merely exemplary of a method of manufacturing jewelery items and jewelery items produced by that method, and that modifications can readily be made thereto without departing from the true scope of the invention as set out in the appended claims.

The invention claimed is:

1. A method of producing a jewelry item which comprises producing an annular or partially annular substrate having an inner periphery and an outer periphery, wherein the inner periphery and the outer periphery define a ring plane, wherein the annular or partially annular substrate is formed with a plurality of ring slots that form notches in the inner periphery extending part way towards the outer periphery, producing a plurality of insert members each formed with an insert slot, each insert member having two openings, one opening to each side of the insert slot, wherein the ring slots are configured to engage the insert members and the insert slots are configured to engage the annular or partially annular substrate, inserting the insert members into the ring slots of the annular or partially annular substrate, with the ring slots of the annular or partially annular substrate and the insert slots of the insert members inter-engaging, wherein each insert member is inserted outward from the inner periphery and positioned substantially perpendicular to the ring plane, and locating one or more jewelry pieces in turn between each pair of neighboring insert members, with edges of each jewelry piece located in the openings of the insert members.

2. The method as claimed in claim 1 which includes the additional step of securing the jewelry pieces in place.

3. The method as claimed in claim 2 wherein the jewelry pieces are secured in place by welding the insert members to the annular or partially annular substrate.

4. The method as claimed in claim 3 wherein the jewelry pieces are secured in place by a laser welding technique.

5. The method as claimed in claim 3 wherein the annular or partially annular substrate is made from platinum.

6. The method as claimed in claim 1 wherein the annular or partially annular substrate and the insert members are cut from a sheet material.

7. The method as claimed in claim 1 wherein the width of each ring slot formed in the annular or partially annular substrate is equal to or approximately 0.01 mm greater than the thickness of the insert members.

8. The method as claimed in claim 1 wherein the outer periphery of the annular or partially annular substrate is formed with a plain edge profile.

9. The method as claimed in claim 1 wherein the outer periphery of the annular or partially annular substrate includes a series of indents for receiving a surface of the jewelry pieces.

10. The method as claimed in claim 1 wherein each ring slot of the annular or partially annular substrate extends from the inner periphery to a position approximately one half of the way towards the outer periphery.

11. The method as claimed in claim 1 wherein one side edge of each ring slot of the annular or partially annular substrate lies along a radius of the annular or partially annular substrate with an opposed side edge of each ring slot including an initial length which is inclined away from the one side edge and a second length which projects to an end face of the ring slot and is inclined towards the one side edge.

12. The method as claimed in claim 1 wherein the ring slots of the annular or partially annular substrate are aligned radially in the ring plane of the annular or partially annular substrate.

13. The method as claimed in claim 1 wherein when engaged, an unslotted portion of each of the insert members at an end of the insert slot contacts an unslotted portion of the annular or partially annular substrate at an end of the ring slot.

14. The method as claimed in claim 1 wherein when engaged, the insert members extend out of the ring plane beyond the annular or partially annular substrate.

15. The method as claimed in claim 1 wherein when the insert members are engaged, an edge of each insert member is aligned with the outer periphery of the annular or partially annular substrate.

16. A method of producing a jewelry item from one or more annular or partially annular substrates, a plurality of insert members and a plurality of jewelry pieces, each annular or partially annular substrate being planar and having an inner periphery and an outer periphery that define a ring plane, and each annular or partially annular substrate including a plurality of radial ring slots that form notches in the inner periphery extending to a position at least one quarter of the way towards the outer periphery, and each insert member including at least one insert slot and at least one bordered or partially bordered opening alongside the at least one insert slot, the method comprising the steps of engaging the at least one insert slot of each insert member within a ring slot of each annular or partially annular substrate perpendicular to the ring plane by inserting the insert member outward from the inner periphery, locating between the bordered or partially bordered openings of neighboring insert members a jewelry piece with opposed side edges of the jewelry piece located within the bordered or partially bordered openings of the neighboring insert members, and repeating these steps until jewelry pieces are located between each neighboring pair of insert members.

17. An item of jewelry produced by producing an annular or partially annular substrate having an inner periphery and an outer periphery, wherein the inner periphery and the outer periphery define a ring plane, wherein the annular or partially annular substrate is formed with a plurality of ring slots that form notches in the inner periphery extending part way towards the outer periphery, producing a plurality of insert members each formed with an insert slot, each insert member having two openings, one opening to each side of the insert slot, wherein the ring slots are configured to engage the insert members and the insert slots are configured to engage the annular or partially annular substrate, inserting the insert members into the ring slots of the annular or partially annular substrate, with the ring slots of the annular or partially annular substrate and the insert slots of the insert members inter-engaging, wherein each insert member is inserted outward from the inner periphery and positioned substantially perpendicular to the ring plane, and locating one or more jewelry pieces in turn between each pair of neighboring insert members, with edges of each jewelry piece located in the openings of the insert members.

* * * * *